US009541894B2

(12) United States Patent
Ono

(10) Patent No.: US 9,541,894 B2
(45) Date of Patent: Jan. 10, 2017

(54) IMAGE FORMING APPARATUS INCLUDING MOVABLE GUIDE SECTION MOVABLY SUPPORTED BY APPARATUS MAIN BODY

(71) Applicant: KYOCERA Document Solutions Inc., Osaka (JP)

(72) Inventor: Tomohisa Ono, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/888,542

(22) PCT Filed: Jan. 15, 2015

(86) PCT No.: PCT/JP2015/050891
§ 371 (c)(1),
(2) Date: Nov. 2, 2015

(87) PCT Pub. No.: WO2015/111492
PCT Pub. Date: Jul. 30, 2015

(65) Prior Publication Data

US 2016/0062306 A1 Mar. 3, 2016

(30) Foreign Application Priority Data

Jan. 22, 2014 (JP) ..... 2014-009081

(51) Int. Cl.
*G03G 21/16* (2006.01)
*G03G 15/00* (2006.01)
*G03G 15/23* (2006.01)

(52) U.S. Cl.
CPC ..... *G03G 21/1638* (2013.01); *G03G 15/234* (2013.01); *G03G 15/6573* (2013.01);
(Continued)

(58) Field of Classification Search
CPC ..... G03G 21/1638; G03G 15/234; G03G 21/1633;G03G 15/6573; G03G 15/6579; G03G 15/70; G03G 21/1695; G03G 2215/00421; G03G 2215/00438; G03G 2215/00544; G03G 2215/00548; G03G 2215/00552; G03G 2221/1675; G03G 2221/169
(Continued)

(56) References Cited

U.S. PATENT DOCUMENTS

2010/0098473 A1* 4/2010 Hosoi ..... B65H 5/38 399/400

FOREIGN PATENT DOCUMENTS

JP 11157699 A * 6/1999
JP 11272144 A * 10/1999
(Continued)

OTHER PUBLICATIONS

International Search Report, PCT/JP2015/050891, Apr. 14, 2015.

*Primary Examiner* — Robert Beatty
(74) *Attorney, Agent, or Firm* — Studebaker & Brackett PC

(57) ABSTRACT

An image forming apparatus (1) includes a main body (10), a recording medium accommodating section (20), a paper feed section (30), an upstream conveyance section (60), an image forming section (40), a downstream conveyance section (70), a reverse conveyance section (P2), a covering member (80), and a movable guide section (90). The downstream conveyance section (70) includes an ejection section (50) and a reversing section (73). The covering member (80) moves between a closed position where the upstream conveyance section (60) is composed and an open position where the upstream conveyance section (60) is exposed. The movable guide section (90) moves between a first position where the downstream conveyance section (70) is composed and a second position where the downstream conveyance section is exposed. The movable guide section (90) moves in
(Continued)

conjunction with the covering member (80), is located at the first position to guide a recording medium reversed by the reversing section (73) from a first reverse path (Pr1) to a second reverse path (Pr2) when the covering member (80) is located at the closed position, and is located at the second position when the covering member (80) is located at the open position.

7 Claims, 5 Drawing Sheets

(52) U.S. Cl.
CPC ..... *G03G 15/6579* (2013.01); *G03G 21/1633* (2013.01); *G03G 2215/00438* (2013.01); *G03G 2215/00544* (2013.01)

(58) Field of Classification Search
USPC ..... 399/21, 401
See application file for complete search history.

(56) References Cited

FOREIGN PATENT DOCUMENTS

| | | | | |
|---|---|---|---|---|
| JP | 2000-044086 | A | | 2/2000 |
| JP | 2004359441 | A | * | 12/2004 |
| JP | 2007091435 | A | * | 4/2007 |
| JP | 2008-127185 | A | | 6/2008 |
| JP | 2008292517 | A | * | 12/2008 |
| JP | 2010-284823 | A | | 12/2010 |

* cited by examiner

IMAGE FORMING APPARATUS INCLUDING MOVABLE GUIDE SECTION MOVABLY SUPPORTED BY APPARATUS MAIN BODY

TECHNICAL FIELD

The present invention relates to image forming apparatuses such as copiers.

BACKGROUND ART

In image forming apparatuses such as copiers, a recording medium such as copy paper may be clogged (hereinafter also referred to as a "jam"). Upon occurrence of a jam, a user removes a recording medium clogged at a part where the jam occurs while referring to a message displayed on a display section.

In order to facilitate jam removal, a structure with a movable reverse conveyance section has been proposed for an image forming apparatus capable of forming an image on both sides of a recording medium. In the image forming apparatus, the reverse conveyance section is turnable between a closed position where the reverse conveyance section is attached to the apparatus body and an open position where the reverse conveyance section protrudes from a side surface of the apparatus body (see Patent Literature 1).

When the reverse conveyance section is located at the closed position, an ejection section from which a recording medium having undergone image formation is ejected is concealed. When the reverse conveyance section is located at the open position, an end part of the ejection section is exposed. Upon occurrence of a jam at the ejection section, a user moves the reverse conveyance section to the open position and inserts a hand into the ejection section to remove the jammed recording medium.

CITATION LIST

Patent Literature

[Patent Literature 1]
Japanese Patent Application Laid-Open Publication No. 2008-127185

SUMMARY OF INVENTION

Technical Problem

However, the image forming apparatus disclosed in Patent Literature 1 suffers from the following problem. That is, in a situation in which the reverse conveyance section is moved to the open position, it is hard for a user to see the recording medium jammed at the ejection section and to reach for the jammed recording medium. Therefore, it is difficult for the user to remove the jam.

The present invention has been made in view of the foregoing and has an objective of providing an image forming apparatus in which jam removal efficiency for a user is increased.

Solution to Problem

An image forming apparatus according to the present invention includes a main body, a recording medium accommodating section, a paper feed section, an upstream conveyance section, an image forming section, a downstream conveyance section, a reverse conveyance section, a covering member, and a movable guide section. The downstream conveyance section includes an ejection section and a reversing section. The recording medium accommodating section accommodates a recording medium. The paper feed section is configured to take out a recording medium from the recording medium accommodating section. The image forming section is configured to form an image on the recording medium. The upstream conveyance section is configured to convey the recording medium taken out by the paper feed section toward the image forming section. The ejection section is configured to eject the recording medium on which the image is formed. The reversing section is configured to reverse a conveyance direction of the recording medium and convey the recording medium. The downstream conveyance section is located downstream of the upstream conveyance section. The recording medium reversed by the reversing section is conveyed along the reverse conveyance section to the upstream conveyance section. The covering member is movably supported by the main body to move between a closing position where the upstream conveyance section is composed and an open position where the upstream conveyance section is exposed. The movable guide section is movably supported by the main body to move between a first position where the downstream conveyance section is composed and a second position where the downstream conveyance section is exposed. The reverse conveyance section includes a first reverse path and a second reverse path. The first reverse path extends along the movable guide section. The second reverse path continues from the first reverse path along the covering member. The movable guide section is configured to move in conjunction with the covering member, located at the first position to guide the recording medium reversed by the reversing section from the first reverse path to the second reverse path when the covering member is located at the closed position, and located at the second position when the covering member is located at the open position.

Advantageous Effects of Invention

According to the present invention, jam removal efficiency for a user can be increased.

DESCRIPTION OF EMBODIMENTS

Figure 1:
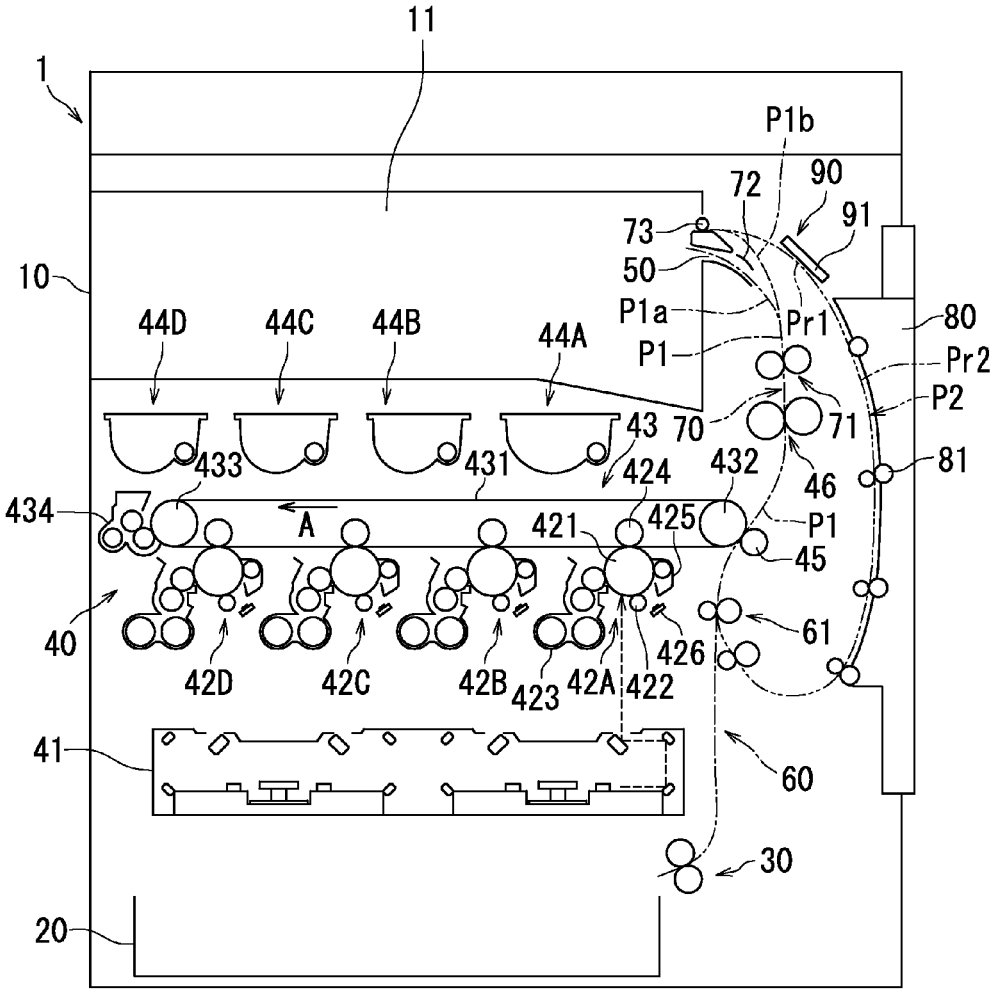
FIG. 1 is a schematic diagram of an image forming apparatus according to an embodiment of the present invention.
Figure 2:
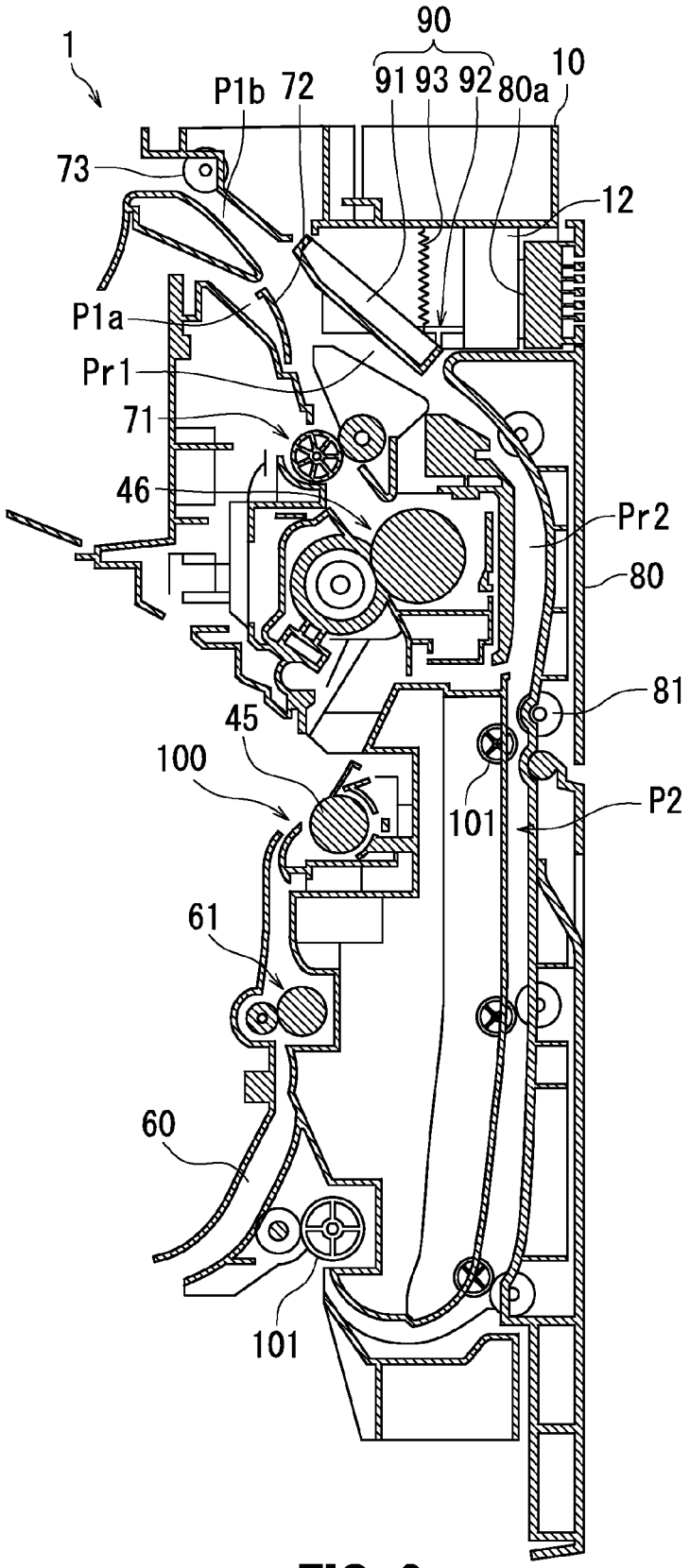
FIG. 2 is a vertical cross sectional view of a side portion of the image forming apparatus illustrated in FIG. 1.
Figure 3:
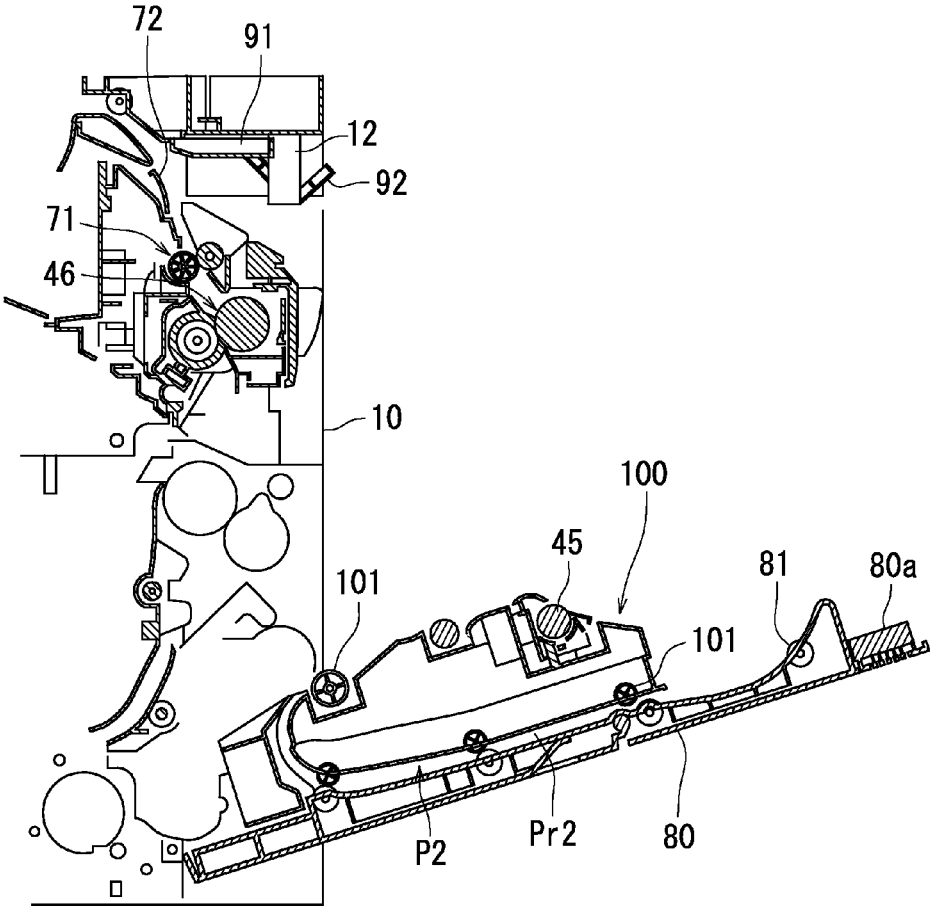
FIG. 3 is a vertical cross sectional view illustrating a state in which the side portion of the image forming apparatus illustrated in FIG. 1 is opened.

Embodiments of the present invention will be described below with reference to the accompanying drawings. FIG. 1 is a schematic diagram of an image forming apparatus 1 according to an embodiment of the present invention. FIG. 2 is a vertical cross sectional view of a side portion of the image forming apparatus 1. FIG. 3 is a vertical cross sectional view illustrating a state in which the side portion of the image forming apparatus 1 is opened.

The image forming apparatus 1 is a multifunction peripheral having functions of copying, faxing, printing, scanning, etc. and includes a main body 10, a paper feed cassette 20 that is a recording medium accommodating section, a paper feed roller pair 30 that is a paper feed section, an image forming section 40, an upstream conveyance section 60, a downstream conveyance section 70, a covering member 80, and a movable guide section 90, as illustrated in FIG. 1.

A stacking area 11 is located in an upper part of the main body 10. In the stacking area 11, recording media (e.g., copier paper) that have undergone image formation and been ejected from an ejection section 50 are kept in a stacked manner.

The paper feed cassette 20 is attachable to and detachable from the main body 10. Recording media are accommodated in a stacked manner in the paper feed cassette 20. The paper feed roller pair 30 takes out a recording medium from the paper feed cassette 20.

The upstream conveyance section 60 conveys the recording medium taken out by the paper feed roller pair 30 toward the image forming section 40.

The image forming section 40 forms an image on the recording medium. The image forming section 40 will be described later in detail.

The downstream conveyance section 70 is located downstream of the upstream conveyance section 60 and conveys the recording medium on which the image is formed toward the stacking area 11.

The downstream conveyance section 70 includes an ejection section 50. The ejection section 50 is located at an upper part of a side surface of the stacking area 11. The ejection section 50 ejects the recording medium on which the image is formed onto the stacking area 11.

The covering member 80 is movably supported by the main body 10 to move between a closed position (see FIG. 2) and an open position (see FIG. 3). When the covering member 80 is located at the closed position, the upstream conveyance section 60 is composed. When the covering member 80 is located at the open position, the upstream conveyance section 60 is exposed. The covering member 80 includes a contact portion 80*a* (a first contact portion). The contact portion 80*a* is located at an upper end of the covering member 80. The contact portion 80*a* will be described later in detail.

The movable guide section 90 includes a movable guide plate 91. The movable guide plate 91 is movably supported by the main body 10 to move between a first position (see FIG. 2) and a second position (see FIG. 3). When the movable guide plate 91 is located at the first position, the downstream conveyance section 70 is composed. When the movable guide plate 91 is located at the second position, the downstream conveyance section 70 is exposed.

The movable guide plate 91 moves in conjunction with the covering member 80. The movable guide plate 91 is located at the first position when the covering member 80 is located at the closed position, and located at the second position when the covering member 80 is located at the open position.

The image forming section 40 includes a laser scanning unit 41, image forming units 42A-42D, an intermediate transfer belt unit 43, toner cartridges 44A-44D, a secondary transfer roller 45, and a fixing section 46.

The laser scanning unit 41 includes light beam generators that generate laser light corresponding to image data, polygon mirrors that reflect light beams irradiated from the light beam generators, fθ lenses that image the light beams reflected by the polygon mirrors onto outer circumferential surfaces of the photosensitive drums 421, which will be described later, etc.

The image forming unit 42A performs black image formation. The image forming unit 42B performs yellow image formation. The image forming unit 42C performs cyan image formation. The image forming unit 42D performs magenta image formation.

The image forming units 42A-42D each include a corresponding one of the photosensitive drums 421, a charger 422, a developing device 423, a primary transfer roller 424, a cleaner 425, and a static eliminator 426.

The charger 422 charges the outer circumferential surface of the photosensitive drum 421. The laser scanning unit 41 forms an electrostatic latent image corresponding to the image data on the outer circumferential surface of the charged photosensitive drum 421.

The developing device 423 supplies toner to the outer circumferential surface of the photosensitive drum 421 to develop the electrostatic latent image on the outer circumferential surface of the photosensitive drum 421, thereby forming a toner image.

The primary transfer roller 424 transfers the toner image on the outer circumferential surface of the photosensitive drum 421 to an intermediate transfer belt 431, which will be described later.

The cleaner 425 removes toner remaining on the outer circumferential surface of the photosensitive drum 421 after transfer of the toner image to the intermediate transfer belt 431.

After the toner image is transferred to the intermediate transfer belt 431, the static eliminator 426 removes charges remaining on the outer circumferential surface of the photosensitive drum 421.

The intermediate transfer belt unit 43 includes the intermediate transfer belt 431, a drive roller 432, a tension roller 433, and a cleaning unit 434. The intermediate transfer belt 431 is endless and wound between the drive roller 432 and the tension roller 433. After the toner image on the intermediate transfer belt 431 is transferred to a recording medium, the cleaning unit 434 cleans the intermediate transfer belt 431.

The toner cartridge 44A supplies a black toner to the developing device 423 of the image forming unit 42A. The toner cartridge 44B supplies a yellow toner to the developing device 423 of the image forming unit 42B. The toner cartridge 44C supplies a cyan toner to the developing device 423 of the image forming unit 42C. The toner cartridge 44D supplies a magenta toner to the developing device 423 of the image forming unit 42D.

The secondary transfer roller 45 is located opposite to the drive roller 432 and nips the recording medium in cooperation with the intermediate transfer belt 431 to transfer the toner image on the intermediate transfer belt 431 to the recording medium.

The fixing section 46 includes a pair of rollers and applies heat and pressure to the recording medium between the pair of rollers to fix the transferred toner image to the recording medium.

The upstream conveyance section 60 includes a pair of registration rollers 61. The pair of registration rollers 61 performs skew correction on the recording medium fed from the paper feed roller pair 30. The pair of registration rollers 61 then temporarily holds the recording medium and then feeds the recording medium to the secondary transfer roller 45 in accordance with timing of transfer of the toner image to the recording medium by the secondary transfer roller 45.

The downstream conveyance section 70 further includes a conveyance roller pair 71, a diverging guide 72, and a reversing roller 73 that is a reversing section. In the following description, among conveyance paths for a recording medium, a conveyance path indicated by a dashed line is referred to as a main conveyance path P1, while a conveyance path indicated by a dashed and double dotted line is referred to as a reversed paper conveyance path P2. The main conveyance path P1 extends from the paper feed roller pair 30 to the ejection section 50 or the reversing roller 73 via the pair of registration rollers 61, the secondary transfer roller 45, and the fixing section 46. The reversed paper conveyance path P2 extends from the reversing roller 73 to the pair of registration rollers 61 via the movable guide section 90 and the covering member 80.

The reversed paper conveyance path P2 includes a reverse path Pr1 (a first reverse path) and a reverse path Pr2 (a second reverse path). The reverse path Pr1 extends along the movable guide plate 91. The reverse path Pr2 continues from the reverse path Pr1 and extends along the inner wall surface of the covering member 80.

The conveyance roller pair 71 conveys the recording medium along the main conveyance path P1. The diverging guide 72 is swingable by an actuator and diverges the main conveyance path P1 into an ejection path P1*a* and a reverse path P1*b*. The ejection path P1*a* guides the recording medium to the ejection section 50. The reverse path P1*b* guides the recording medium having an image formed on one side to the reversing roller 73.

The reversing roller 73 reverses a conveyance direction of the recording medium having the image formed on one side and conveys the recording medium along the reversed paper conveyance path P2. The recording medium reversed by the reversing roller 73 is conveyed along the reversed paper conveyance path P2 to the upstream conveyance section 60. The reversed paper conveyance path P2 functions as a reverse conveyance section in the present invention.

The covering member 80 is pivotally supported at a lower end thereof by the main body 10 to pivot within a vertical plane. The covering member 80 includes a plurality of guide rollers 81. The plurality of guide rollers 81 are disposed along the reversed paper conveyance path P2.

The movable guide plate 91 is pivotally supported at one end thereof by the main body 10 to pivot within a vertical plane. The movable guide plate 91 is located between the reversing roller 73 and the reverse path Pr2. The movable guide plate 91 guides the recording medium reversed by the reversing roller 73 from the reverse path Pr1 to the reverse path Pr2.

As illustrated in FIG. 2, the image forming apparatus 1 further includes a conveyance unit 100. The conveyance unit 100 composes a part of the upstream conveyance section 60 and constitutes the reversed paper conveyance path P2 between the conveyance unit 100 and the covering member 80. The conveyance unit 100 is supported by the covering member 80. When the covering member 80 is pivoted to the open position, the conveyance unit 100 is moved in conjunction with the covering member 80 to protrude from the main body 10.

The conveyance unit 100 includes the secondary transfer roller 45, one of the pair of registration rollers 61, and a plurality of guide rollers 101. The plurality of guide rollers 101 are disposed along the reversed paper conveyance path P2.

Figure 4A:
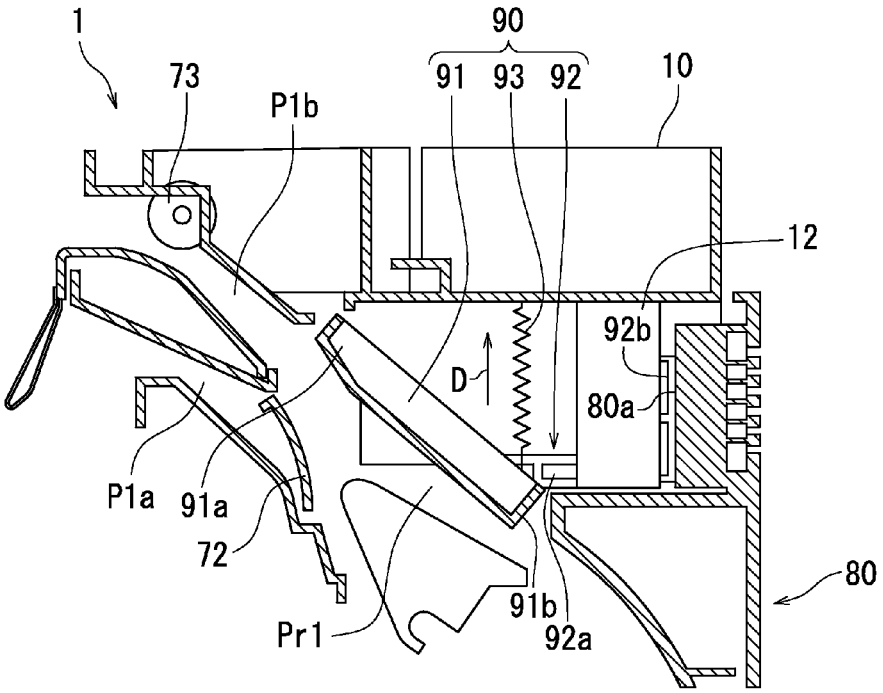
FIG. 4A is an enlarged view illustrating a state in which a movable guide plate illustrated in FIG. 2 is located at a first position.
Figure 4B:
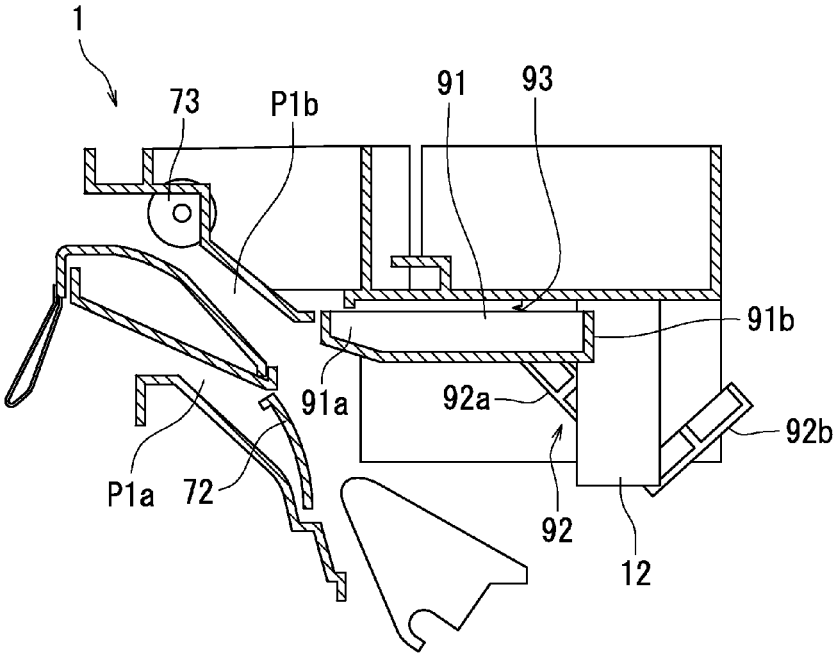
FIG. 4B is an enlarged view illustrating a state in which the movable guide plate illustrated in FIG. 2 is located at a second position.
Figure 5:
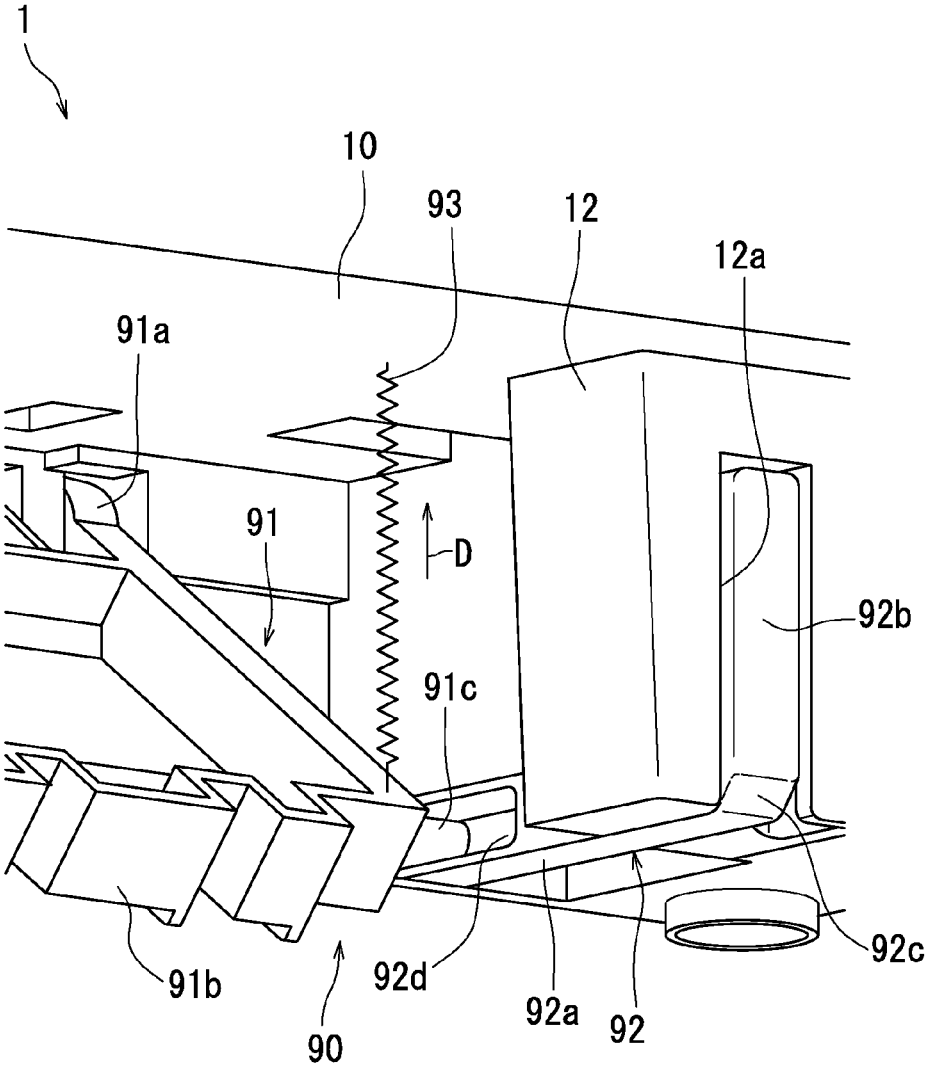
FIG. 5 is a perspective view of an ejection guide illustrated in FIG. 2 and section therearound.

A linkage configuration between the movable guide section 90 and the covering member 80 will be described next with reference to FIGS. 4A, 4B, and 5. FIGS. 4A and 4B each are a partially enlarged view of FIG. 2. FIG. 4A illustrates a state in which the movable guide plate 91 is located at the first position. FIG. 4B illustrates a state in which the movable guide plate 91 is located at the second position. FIG. 5 is a perspective view of the movable guide section 90 and section therearound. FIG. 5 illustrates a state in which the movable guide plate 91 is located at the first position while not illustrating the covering member 80 for the sake of simplicity of the drawing.

As illustrated in FIGS. 4A and 4B, the movable guide plate 91 is pivotally supported by the main body 10 between the first and second positions. Specifically, one end part 91*a* of the movable guide plate 91 is pivotally supported by the main body 10. As a result, the movable guide plate 91 is capable of pivoting from the first position to the second position and from the second position to the first position.

The movable guide section 90 further includes a linkage member 92 and a spring 93 that is an urging member.

The linkage member 92 is pivotally supported by the main body 10. One end part of the linkage member 92 engages with the movable guide plate 91, while the other end part thereof is separable from and contactable with the covering member 80.

The spring 93 is located between the main body 10 and the movable guide plate 91 and urges the movable guide plate 91 toward the second position. Specifically, the spring 93 urges the other end part 91*b* of the movable guide plate 91 in a direction D in which the spring 93 is compressed. In the state illustrated in FIG. 4B, the spring 93 urges the movable guide plate 91 so as to open the ejection path P1*a* and the reverse path P1*b*.

The covering member 80 presses the linkage member 92 when located at the closed position and is separated from the linkage member 92 when located at the open position.

The linkage member 92 positions the movable guide plate 91 at the first position when the covering member 80 is located at the closed position and allows the movable guide plate 91 to pivot to the second position when the covering member 80 is located at the open position. In other words, the movable guide plate 91 is positioned at the first position through the linkage member 92 pressed by the covering member 80 located at the closed position. By contrast, the movable guide plate 91 is urged to the second position by the spring 93 when the covering member 80 is located at the open position.

As illustrated in FIG. 5, the main body 10 includes a support member 12. The support member 12 has a slit portion 12*a* in an inverted U-shape.

The linkage member 92 has an L-shape. The linkage member 92 includes a corner portion 92*c*. The linkage member 92 is supported by the support member 12 pivotally about the corner portion 92*c*.

The linkage member 92 further includes an engaging portion 92*a* and a contact portion 92*b* (a second contact portion). The engaging portion 92*a* has an engaging recess 92*d* in a side surface thereof. The engaging recess 92*d* extends in a longitudinal direction of the engaging portion 92*a*. The contact portion 92*b* is housed in the slit portion 12*a* in a manner that the contact portion 92*b* is allowed to enter into and exit from the slit portion 12*a*.

The movable guide plate 91 includes a support shaft 91*c*. The support shaft 91*c* protrudes horizontally from a side surface of the other end part 91*b* of the movable guide plate 91. The support shaft 91*c* engages with the engaging recess 92*d* slidably in the longitudinal direction.

When the covering member 80 is located at the closed position, the contact portion 80*a* of the covering member 80 is in contact with the contact portion 92*b* of the linkage member 92. The urging force of the spring 93 acts on the linkage member 92 through the support shaft 91*c* to urge the linkage member 92 in a direction in which the linkage member 92 is projected from the slit portion 12*a*. Contact of the contact portion 80*a* with the contact portion 92*b* maintains the linkage member 92 in the state illustrated in FIG. 5 (a state in which the contact portion 92*b* is housed in the slit portion 12*a*). As a result, the movable guide plate 91 is maintained at the first position. Further, the contact portion 92*b* is substantially parallel to the contact portion 80*a* when the covering member 80 is located at the closed position. The above configuration can achieve stable positioning of the movable guide plate 91 at the first position.

When the covering member 80 is moved to the open position, the movable guide plate 91, the linkage member 92, the spring 93, and the support member 12 that are concealed by the covering member 80 are exposed. Further, the covering member 80 moves away from the contact portion 992*b* of the linkage member 92 to pivot the linkage member 92. As a result, the movable guide plate 91 moves to the second position to expose the reverse path P1*b* and the ejection path P1*a*. The linkage member 92 has an L-shape with the corner portion 92*c* that is pivotally supported, and therefore, can be compact to reserve a space for the movable guide plate 91 pivoting at a necessary rotation angle (about 40 degrees).

With reference to FIGS. 2-4B, a jam removing process in the image forming apparatus 1 will be described next. Upon occurrence of a jam in the reverse path P1*b* or the ejection path P1*a*, a user moves the covering member 80 from the closed position illustrated in FIG. 2 to the open position illustrated in FIG. 3. In conjunction therewith, the movable guide plate 91 is moved from the first position illustrated in FIG. 4A to the second position illustrated in FIG. 4B, thereby exposing the reverse path P1*b* and the ejection path P1*a*. The user inserts a hand into the reverse path P1*b* or the ejection path P1*a* from the outside of the image forming apparatus 1 and removes a jammed recording medium.

After jam removal, the user pivots the covering member 80 from the open position illustrated in FIG. 3 to the closed position illustrated in FIG. 2. In conjunction therewith, the movable guide plate 91 is moved from the second position illustrated in FIG. 4B to the first position illustrated in FIG. 4A, thereby concealing the ejection path P1*a* and the reverse path P1*b*.

In the image forming apparatus 1, when the covering member 80 is opened, the movable guide section 90 is moved in conjunction to expose the downstream conveyance section 70. Thus, a user can remove a jam efficiently as compared to an image forming apparatus without the movable guide section 90. Further, the movable guide plate 91, the linkage member 92, and the spring 93 constitute a configuration for jam removal in the image forming apparatus 1. In the above configuration, the fixing section 46 and the conveyance unit 100 can be used in common with those used in an existing image forming apparatus. As such, the fixing section 46 and the conveyance unit 100 are not necessarily designed anew, thereby enabling cost reduction for molds.

Further, as illustrated in FIG. 2, the ejection path P1*a* extends upward in the image forming apparatus 1. In the above configuration, a distance between the bottom of the stacking area 11 (see FIG. 1) and the ejection section 50 can be increased to increase the amount of recording media that the stacking area 11 is able to stock as compared to a configuration in which the ejection path P1*a* extends horizontally. As a result, even when speed of recording medium processing is increased in the image forming apparatus 1, a situation in which recording media having undergone image formation overflow from the stacking area 11 can be prevented. Thus, the image forming apparatus 1 can achieve high speed processing on a recording medium.

A specific embodiment of the present invention has been described so far. However, the present invention is not limited to the above embodiment and various alterations can be made to the embodiment within the scope not departing from the spirit of the present invention.

For example, the ejection path extends obliquely upward from the reverse conveyance section in the present embodiment, but the direction in which the ejection path extends from the reverse conveyance section is not limited in the present invention. The present invention is applicable to a configuration in which the ejection path extends from the reverse conveyance section in a direction other than the obliquely upward direction (e.g., a horizontal direction from the reverse conveyance section).

Moreover, the present embodiment describes a situation in which the present invention is applied to an image forming apparatus that performs image formation on both sides of a recording medium, that is, an image forming apparatus including a reverse conveyance section. However, the present invention is applicable to an image forming apparatus that performs image formation on a single side of a recording medium.

In addition, the present invention is applied to an electrographic image forming apparatus in the present embodiment but is applicable to image forming apparatuses other than the electrographic image forming apparatus (e.g., inkjet image forming apparatuses).

Various other alterations can be made further to the present embodiment within the scope not departing from the spirit of the present invention.

The invention claimed is:

1. An image forming apparatus comprising:

a main body;

a recording medium accommodating section that accommodates a recording medium;

a paper feed section configured to take out the recording medium from the recording medium accommodating section;

an image forming section configured to form an image on the recording medium;

an upstream conveyance section configured to convey the recording medium taken out by the paper feed section toward the image forming section;

a downstream conveyance section including an ejection section and a reversing section and located downstream of the upstream conveyance section, the ejection section being configured to eject the recording medium on which the image is formed, the reversing section being configured to reverse a conveyance direction of the recording medium and convey the recording medium;

a reverse conveyance section along which the recording medium reversed by the reversing section is conveyed to the upstream conveyance section;

a covering member movably supported by the main body to move between a closed position where the upstream conveyance section is formed and an open position where the upstream conveyance section is exposed; and a movable guide section movably supported by the main body to move between a first position where the downstream conveyance section is formed and a second position where the downstream conveyance section is exposed, wherein the downstream conveyance section further includes a diverging guide that diverges a main conveyance path into an ejection path and a reverse path, the ejection path guides the recording medium to the ejection section, the reverse path guides the recording medium to the reversing section, the movable guide section is located opposite to the diverging guide, the reverse conveyance section includes:

a first reverse path formed along an inner side surface of the movable guide section; and a second reverse path formed along an inner wall surface of the covering member and continuing from the first reverse path, the covering member being located on a downstream side of the movable guide section in a conveyance direction in which the reverse conveyance section conveys the recording medium, and the movable guide section is configured to move in conjunction with the covering member, located at the first position to guide the recording medium reversed by the reversing section from the first reverse path to the second reverse path when the covering member is located at the closed position, and located at the second position when the covering member is located at the open position.

2. The image forming apparatus according to claim 1, further comprising:

a conveyance unit that forms the upstream conveyance section, that constitutes the reverse conveyance section between the conveyance unit and the covering member, and that is supported by the covering member.

3. An image forming apparatus comprising:

a main body;

a recording medium accommodating section that accommodates a recording medium;

a paper feed section configured to take out the recording medium from the recording medium accommodating section;

an image forming section configured to form an image on the recording medium;

an upstream conveyance section configured to convey the recording medium taken out by the paper feed section toward the image forming section;

a downstream conveyance section including an ejection section and a reversing section and located downstream of the upstream conveyance section, the ejection section being configured to eject the recording medium on which the image is formed, the reversing section being configured to reverse a conveyance direction of the recording medium and convey the recording medium;

a reverse conveyance section along which the recording medium reversed by the reversing section is conveyed to the upstream conveyance section;

a covering member movably supported by the main body to move between a closed position where the upstream conveyance section is formed and an open position where the upstream conveyance section is exposed; and a movable guide section movably supported by the main body to move between a first position where the downstream conveyance section is formed and a second position where the downstream conveyance section is exposed, wherein the reverse conveyance section includes:

a first reverse path along the movable guide section; and a second reverse path continuing from the first reverse path along the covering member, the movable guide section is configured to move in conjunction with the covering member, located at the first position to guide the recording medium reversed by the reversing section from the first reverse path to the second reverse path when the covering member is located at the closed position, and located at the second position when the covering member is located at the open position, and the movable guide section includes:

a movable guide plate pivotally supported by the main body between the first position and the second position;

a linkage member pivotally supported by the main body and having one end part that engages with the movable guide plate and another end part that is separable from and contactable with the covering member; and an urging member configured to urge the movable guide plate toward the second position, the covering member presses the linkage member when located at the closed position and is separated from the linkage member when located at the open position, the movable guide plate is positioned at the first position by pressing of the linkage member when the covering member is located at the closed position, and positioned at the second position by urging of the urging member when the covering member is located at the open position, the covering member includes a first contact portion, the main body includes a support member having a slit portion in an inverted U-shape, the linkage member further includes:

an engaging portion that engages with the movable guide plate; and a second contact portion that is in contact with the first contact portion of the covering member when the covering member is located at the closed position, the linkage member has an L-shape with a corner portion and is supported by the support member pivotally about the corner portion, and the second contact portion is housed in the slit portion in a manner that the second contact portion is allowed to enter into and exit from the slit portion.

4. The image forming apparatus according to claim 3, wherein the covering member includes a first contact portion, the second contact portion is parallel to the first contact portion when the covering member is located at the closed position.

5. The image forming apparatus according to claim 3, further comprising:

a conveyance unit that forms the upstream conveyance section, that constitutes the reverse conveyance section between the conveyance unit and the covering member, and that is supported by the covering member.

6. An image forming apparatus comprising:

a main body;

a recording medium accommodating section that accommodates a recording medium;

a paper feed section configured to take out the recording medium from the recording medium accommodating section;

an image forming section configured to form an image on the recording medium;

an upstream conveyance section configured to convey the recording medium taken out by the paper feed section toward the image forming section;

a downstream conveyance section including an ejection section and a reversing section and located downstream of the upstream conveyance section, the ejection section being configured to eject the recording medium on which the image is formed, the reversing section being configured to reverse a conveyance direction of the recording medium and convey the recording medium;

a reverse conveyance section along which the recording medium reversed by the reversing section is conveyed to the upstream conveyance section;

a covering member movably supported by the main body to move between a closed position where the upstream conveyance section is formed and an open position where the upstream conveyance section is exposed; and a movable guide section movably supported by the main body to move between a first position where the downstream conveyance section is formed and a second position where the downstream conveyance section is exposed, wherein the reverse conveyance section includes:

a first reverse path along the movable guide section; and a second reverse path formed continuing from the first reverse path along the covering member, the movable guide section is configured to move in conjunction with the covering member, located at the first position to guide the recording medium reversed by the reversing section from the first reverse path to the second reverse path when the covering member is located at the closed position, and located at the second position when the covering member is located at the open position, the movable guide section includes:

a movable guide plate pivotally supported by the main body between the first position and the second position;

a linkage member pivotally supported by the main body and having one end art that engages with the movable guide plate and another end part that is separable from and contactable with the covering member; and an urging member configured to urge the movable guide plate toward the second position, the covering member presses the linkage member when located at the closed position and is separated from the linkage member when located at the open position, the movable guide plate is positioned at the first position by pressing of the linkage member when the covering member is located at the closed position, and positioned at the second position by urging of the urging member when the covering member is located at the open position, the covering member includes a first contact portion, the movable guide plate has one end part pivotally supported by the main body, the movable guide plate has another end part urged by the urging member, the linkage member further includes:

an engaging portion that engages with the movable guide plate; and a second contact portion that is in contact with the first contact portion of the covering member when the covering member is located at the closed position, the engaging portion has an engaging recess extending in a longitudinal direction of the engaging portion, the movable guide plate includes a support shaft protruding from the other end part of the movable guide plate, and the support shaft engages with the engaging recess slidably in the longitudinal direction.

7. The image forming apparatus according to claim 6, further comprising:

a conveyance unit that forms the upstream conveyance section, that constitutes the reverse conveyance section between the conveyance unit and the covering member, and that is supported by the covering member.

* * * * *